United States Patent [19]

Brooker

[11] Patent Number: 4,511,899

[45] Date of Patent: Apr. 16, 1985

[54] HORN-REFLECTOR MICROWAVE ANTENNA WITH INTERNAL DEBRIS TRAP

[75] Inventor: Eric L. Brooker, Hinsdale, Ill.

[73] Assignee: Andrew Corporation, Orland Park, Ill.

[21] Appl. No.: 453,239

[22] Filed: Dec. 27, 1982

[51] Int. Cl.[3] ..... H01Q 13/02

[52] U.S. Cl. ..... 343/784; 343/786

[58] Field of Search ..... 343/784, 786, 840; 333/252

[56] References Cited

U.S. PATENT DOCUMENTS

| | | | |
|---|---|---|---|
| 2,403,909 | 7/1946 | Carter | 343/786 |
| 2,809,371 | 10/1957 | Carter et al. | 343/784 |
| 3,114,123 | 12/1963 | Kreuchen et al. | 333/252 |

*Primary Examiner*—Eli Lieberman

*Attorney, Agent, or Firm*—Leydig, Voit, Osann, Mayer & Holt, Ltd.

[57] ABSTRACT

A horn-reflector microwave antenna comprises the combination of a paraboloidal reflector for transmitting and receiving microwave signals; a tapered feed horn extending downwardly from the reflector for guiding microwave signals to and from the reflector; a waveguide connected to the lower end of the feed horn; and a dielectric membrane extending across the interior of the feed horn for collecting any debris that falls down into the feed horn. In the preferred embodiment of the invention, the outer periphery of the dielectric membrane is secured to the interior walls of the feed horn, and the central portion of the membrane is elevated above the periphery thereof so that debris collected on the membrane slides to the walls of the feed horn.

6 Claims, 3 Drawing Figures

HORN-REFLECTOR MICROWAVE ANTENNA WITH INTERNAL DEBRIS TRAP

TECHNICAL FIELD

The present invention relates generally to microwave antennas and, more particularly, to microwave antennas of the horn-reflector type. This invention is particularly concerned with the effect of internal debris on the performance of such antennas and systems incorporating such antennas.

BACKGROUND ART

Horn-reflector antennas have been known for many years. For example, a 1963 article in *The Bell System Technical Journal* describes a conical horn-reflector antenna for use in satellite communication ground stations (Hines et al., "The Electrical Characteristics Of The Conical Horn-Reflector Antenna", *The Bell System Technical Journal*, July 1963, pp. 1187–1211). A conical horn-reflector antenna is also described in Dawson U.S. Pat. No. 3,550,142, issued Dec. 22, 1970. A 1969 article by Y. Takeichi et al. entitled "The Diagonal Horn-Reflector Antenna", *IEEE G-AP Symp.*, pp. 279–285, Dec. 9–11, 1969, describes a so-called "diagonal" horn-reflector antenna, in which the flared horn has a square aperture (i.e., the cross section of the horn, taken in a plane perpendicular to its axis, is square).

One of the problems with horn-reflector antennas is that loose materials can enter the feed horn after the antenna has been installed, particularly when the antenna remains in the field over a period of years and is subjected to varying environmental conditions. For example, it is not uncommon for bullets to enter such antennas as a result of vandalism, and various other types of particulate matter also enter such antennas from time to time. The absorber material that is used to line certain portions of such antennas can also fracture or become dislodged. Any of these loose materials which enter or break loose in the interior of the antenna fall down through the tapered feed horn and either accumulate in bends in the waveguide or become trapped in the feed horn or the waveguide. These accumulations of particulate material and other debris tend to lodge in close to the waveguide entry and can seriously degrade the antenna performance, such as by increasing the attenuation of the microwave signals transmitted and/or received by the antenna.

DISCLOSURE OF THE INVENTION

It is, therefore, a primary object of the present invention to provide an improved horn-reflector antenna which minimizes the effect of loose debris, in the interior of the antenna, on the performance of the antenna. In this connection, one specific object of the invention is to provide such an improved antenna which prevents debris from entering the waveguide connected to the bottom of the feed horn.

It is another important object of this invention to provide such an improved horn-reflector antenna which facilitates removal of debris from the interior of the antenna.

A further object of this invention is to provide an improved horn-reflector antenna of the foregoing type which does not significantly increase the cost of the antenna.

Other objects and advantages of this invention will be apparent from the following detailed description and the accompanying drawings.

The present invention satisfies the foregoing objectives by providing a horn-reflector microwave antenna comprising the combination of a paraboloidal reflector for transmitting and receiving microwave signals; a tapered feed horn extending downwardly from the reflector for guiding microwave signals to and from the reflector; a waveguide connected to the lower end of the feed horn; and a dielectric membrane extending across the interior of the feed horn for collecting any debris that falls down into the feed horn. In the preferred embodiment of the invention, the outer periphery of the dielectric membrane is secured to the interior walls of the feed horn, and the central portion of the membrane is elevated above the periphery thereof so that debris collected on the membrane slides to the walls of the feed horn.

BEST MODE FOR CARRYING OUT THE INVENTION

Figure 1:
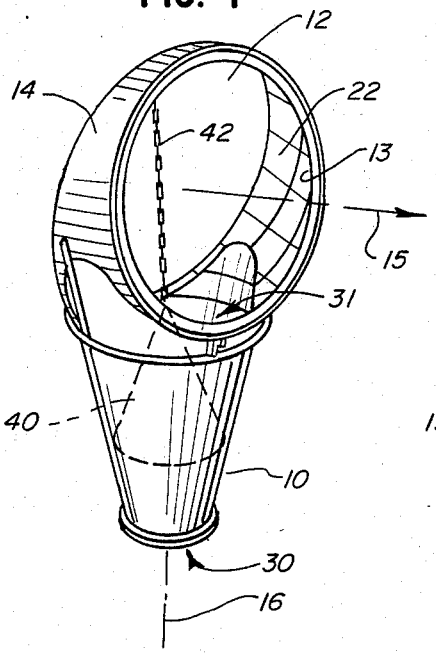
FIG. 1 is a perspective view of a horn-reflector antenna embodying the present invention.

While the invention will be described in connection with certain preferred embodiments, it will be understood that it is not intended to limit the invention to those particular embodiments. On the contrary, it is intended to cover all alternatives, modifications and equivalents as may be included within the spirit and scope of the invention as defined by the amended claims.

Turning now to the drawings, there is illustrated a horn-reflector microwave antenna having a flared horn 10 for guiding microwave signals between a waveguide 11 and a parabolic reflector plate 12. From the reflector plate 12, the microwave signals are transmitted through an aperture 13 formed in the front of a cylindrical section 14 which is attached to both the horn 10 and the reflector plate 12 to form a completely enclosed integral antenna structure.

Figure 2:
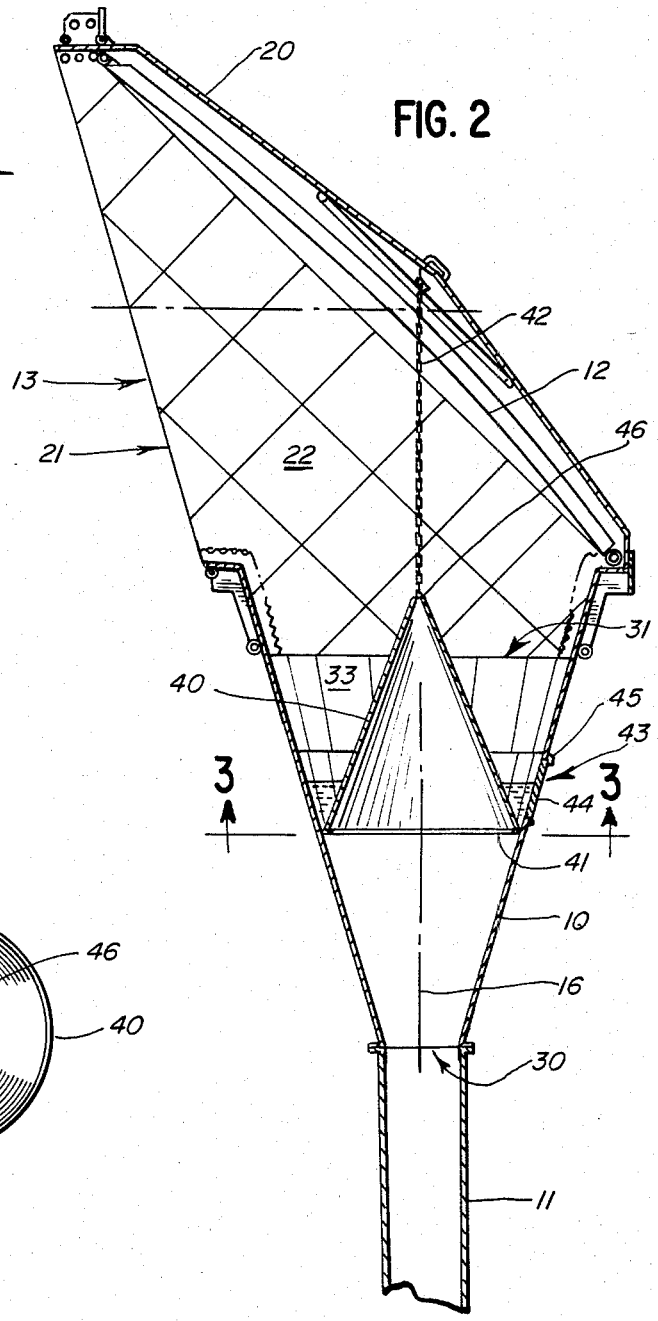
FIG. 2 is an enlarged vertical section of the antenna shown in FIG. 1, connected to a waveguide.
Figure 3:
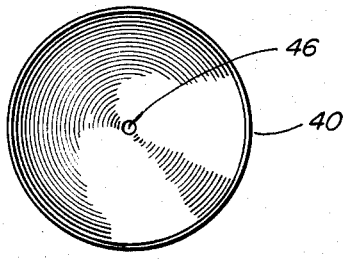
FIG. 3 is a horizontal section taken generally along the line 3—3 in FIG. 2.

The parabolic reflector plate 12 is a section of a paraboloid representing a surface of revolution formed by rotating a parabolic curve about an axis which extends through the vertex and the focus of the parabolic curve. As is well known, any microwaves originating at the focus of such a parabolic surface will be reflected by the plate 12 in planar wavefronts perpendicular to said axis, i.e., in the direction indicated by the arrow 15 in FIG. 2. Thus, the horn 10 of the illustrative antenna is arranged so that its apex coincides with the focus of the paraboloid, and so that the axis 16 of the horn is perpendicular to the axis of the paraboloid. With this geometry, a diverging spherical wave emanating from the horn 10 and striking the reflector plate 12 is reflected as a plane wave which passes through the aperture 13 with an orientation which is perpendicular to the plane formed by the intersection of the axis of the horn with the axis of the paraboloid. The cylindrical section 14 serves as a shield which prevents the reflector plate 12 from producing interfering side and back signals and also helps to capture some spillover energy launched from the horn 10. It will be appreciated that the horn 10, the waveguide 11, the reflector plate 12, and the cylindrical shield 14 are usually all formed of conductive metal.

To protect the interior of the antenna from both the weather and stray signals, the top of the reflector plate 12 is covered by a panel 20 attached to the cylindrical shield 14. A radome 21 also covers the aperture 13 at the front of the antenna to provide further protection from the weather. The inside surface of the cylindrical shield 14 is covered with an absorber material 22 to absorb stray signals so that they do not degrade the RPE. Such absorber materials are well known in the art, and typically comprise a conductive material such as metal or carbon dispersed throughout a dielectric material.

In the particular embodiment illustrated, the flared horn 10 has a conical configuration forming a circular aperture 30 at the lower end of the horn and a circular aperture 31 at the top end of the horn. Microwave signals are fed through the circular waveguide 11 into the lower aperture 30. To produce E and H plane fields that are as equal as possible in the conical horn 10, the upper portions of the interior walls of the horn are lined with a layer of absorber material 33 which extends continuously around the entire inner surface of the cone. Conventional absorber materials may be used for this purpose, being secured to the metal walls of the horn by means of an adhesive.

In accordance with an important aspect of the present invention, a dielectric membrane is provided across the interior of the feed horn for collecting any debris that falls down into the horn. Thus, in the illustrative embodiment shown in the drawings, a dielectric membrane 40 of generally conical shape extends downwardly from the axis of the feed horn 10 to the walls thereof so that falling debris trapped by the conical membrane 40 gravitates to the outer edge of the membrane. Thus, the debris tends to accumulate in a narrow region adjacent the interior walls of the horn 10 and a substantial distance above the lower horn aperture 30. Accumulation of a modest amount of debris in this location can be tolerated without appreciable degradation of the performance of the antenna system, in contrast to the substantial degradation that can occur if the debris is allowed to pass down into the waveguide 32 and become lodged therein. Because the membrane 40 is itself made of a dielectric material, it has no significant deleterious effect on the performance of the antenna system.

To ensure that any absorber material that breaks loose is trapped before it enters the waveguide, the lower edge of the conical membrane is preferably located below the bottom edge of the absorber material 22. The lower edge of the membrane 40 may be held in place by a dielectric ring 41 secured thereto, or may be adhesively bonded to the interior walls of the feed horn 10. To minimize the thickness of the membrane 40, it is preferably made of a material that is too thin to support itself inside the feed horn; for example, the membrane may be formed from a sheet or film of dielectric material such as polyethylene, fiberglass, mylar, glass cloth or the like having a thickness sufficient to withstand the impact of any falling debris inside the horn. To support the conical membrane 40, the apex of the cone is attached to a dielectric cord 42 which is attached at its upper end to the reflector plate 12. Alternatively, the membrane can be formed from a material that is stiff enough to support itself, such as a rigid polystyrene foam or Plexiglas; these materials can be of any desired thickness, as long as they are not so thick as to unduly attenuate or reflect radio frequency signals.

In order to provide access to the upper surface of the dielectric membrane 40 so that debris collected thereon can be removed, a port 43 is formed in the side wall of the feed horn 10. Removal of debris via the port 43 avoids the need to disassemble the antenna for the removal of foreign material. This port 43 is normally closed by a removable closure plate 44 made of the same material as the walls of the horn 10 so that the portion of the horn wall containing the access port 43 is as continuous as possible. This is desirable because discontinuities in the interior surface of the conical horn 10 can give rise to the excitation of unwanted modes of the microwave signals being propagated therethrough. In the particular embodiment illustrated in FIG. 2, the closure plate 44 is held in place by a hinge at its bottom edge and a latch 45 at its top edge.

As a further feature of the invention, the dielectric membrane 40 permits air to pass therethrough so that the air pressure will always be the same on opposite sides of the membrane. This feature is desirable because most horn-reflector antennas are pressurized. In the particular embodiment illustrated, a small vent opening 46 is formed in the membrane 40 at the apex of the cone. Alternatively, other portions of the membrane 40 may be perforated, or the entire membrane may be made of a porous material which allows the air pressure to equalize on opposite sides of the membrane without allowing particulate matter to pass through the membrane.

Although the invention has been described with specific reference to a conical membrane, it will be appreciated that other geometric shapes can be utilized. For example, the sloping surfaces of the membrane could be convex or concave. Even a flat membrane can be utilized if it is located well above the lower end of the feed horn. In the case of a "diagonal" horn-reflector antenna, a dielectric membrane in the form of a tetrahedron may be used.

As can be seen from the foregoing detailed description, this invention provides an improved horn-reflector microwave antenna which minimizes the effect of loose debris in the interior of the antenna, on the performance of the antenna. The dielectric membrane provided across the interior of the horn portion of the antenna prevents the debris from entering the waveguide connected to the lower end of the horn, and causes the debris to gravitate to a location where its effect on the performance of the antenna system is minimized. The access port formed in the side wall of the horn facilitates removal of debris from the interior of the antenna. Finally, this improved antenna structure does not significantly add to the cost of the antenna.

I claim as my invention:

1. A horn-reflector microwave antenna comprising the combination of a paraboloidal reflector for transmitting and receiving microwave signals, a tapered feed horn extending downwardly from said reflector for guiding microwave signals to and from said reflector, a waveguide connected to the lower end of said feed horn, and a dielectric membrane extending across the interior of said feed horn for collecting any debris that falls down into said feed horn, wherein the outer periphery of said dielectric membrane is secured to the interior walls of said feed horn, and the central portion of said membrane is elevated above the periphery thereof so that debris collected on said membrane slides to the walls of said feed horn where the effect of such debris on the performance of the antenna is minimized.

2. A horn-reflector antenna as set forth in claim 1 wherein said dielectric membrane is generally conical in shape, extending downwardly from the axis of said feed horn to the walls thereof.

3. A horn-reflector antenna as set forth in claim 1 which includes access means in at least one wall of the antenna for providing access to the upper surface of said dielectric membrane so that debris collected thereon can be removed.

4. A horn-reflector antenna as set forth in claim 1 wherein said dielectric membrane permits air to pass therethrough so that air pressure can equalize on opposite sides of said membrane.

5. A horn-reflector antenna as set forth in claim 4 wherein at least one aperture is formed in said membrane to permit air to pass therethrough.

6. A horn-reflector antenna as set forth in claim 4 wherein said membrane is porous to permit air to pass therethrough.

* * * * *